US005502845A

United States Patent [19]

Hayashi et al.

[11] Patent Number: 5,502,845

[45] Date of Patent: Apr. 2, 1996

[54] SIPHON-JET FLUSH WATER SUPPLY SYSTEM FOR TOILET STOOL

[75] Inventors: Ryosuke Hayashi; Katsuichi Irifune; Yoshiki Ohta; Takashi Yoshioka; Osamu Tsutsui; Atsuo Makita; Ryouichi Tsukada; Shinji Shibata; Noboru Shinbara; Takayuki Ootani; Nobuichiro Ohsato, all of Fukuoka, Japan

[73] Assignee: Toto Ltd., Fukuoka, Japan

[21] Appl. No.: 33,836

[22] Filed: Mar. 19, 1993

Related U.S. Application Data

[63] Continuation-in-part of Ser. No. 713,437, Jun. 10, 1991, Pat. No. 5,204,999.

[51] Int. Cl.[6] ..... E03D 1/00

[52] U.S. Cl. ..... 4/300; 4/425; 4/421; 4/420; 4/332

[58] Field of Search ..... 4/300, 425, 421, 4/422, 329, 330, 331, 332, 333, 363

[56] References Cited

U.S. PATENT DOCUMENTS

| | | | |
|---|---|---|---|
| 1,973,349 | 9/1934 | Kruse | 4/425 |
| 4,734,943 | 4/1988 | Mellinger et al. | 4/300 |
| 4,819,279 | 4/1989 | Sigler et al. | 4/321 |
| 5,305,475 | 4/1994 | Jaeckels et al. | 4/353 |

FOREIGN PATENT DOCUMENTS

| | | | |
|---|---|---|---|
| 223764 | 2/1986 | European Pat. Off. | 4/425 |

*Primary Examiner*—Henry J. Recla
*Assistant Examiner*—David J. Walczak
*Attorney, Agent, or Firm*—Weiner, Carrier & Burt; Joseph P. Carrier; Irving M. Weiner

[57] ABSTRACT

A flush toilet stool includes a toilet bowl and a trap drainage passage connected to the toilet bowl. The toilet bowl has a water jet hole defined in a bottom region thereof and opening toward the trap drainage passage. A pressurizing unit such as a water pump is coupled to the water jet hole for drawing water under lower pressure directly from an external water supply and expelling the water under higher pressure through the water jet hole toward the trap drainage passage to develop a siphon flow to discharge sewage from the toilet bowl through the trap drainage passage.

19 Claims, 7 Drawing Sheets

SIPHON-JET FLUSH WATER SUPPLY SYSTEM FOR TOILET STOOL

REFERENCE TO RELATED APPLICATION

The present invention is a continuation-in-part application of corresponding U.S. patent application Ser. No. 713,437 filed Jun. 10, 1991.

BACKGROUND OF THE INVENTION

1. Field of the Invention

The present invention relates to a siphon-jet flush water supply system for controlling the supply of flush water to a toilet bowl.

2. Description of the Related Art

FIG. 1 of the accompanying drawings shows a conventional flush toilet with a siphon-jet flush water supply system. Flush water supplied from an external water supply pipe (not Shown) through a flush valve is ejected from a jet hole 101 into a pool W of water in a toilet bowl as indicated by the arrow A. The flush water ejected from the jet hole 101 produces a siphon flow as indicated by the arrow B in a siphon drain passage 102, draining the sewage together with the flush water out of the toilet bowl. The conventional siphon-jet toilet is widely used because no odor is given off as the sewage sinks in the pool W of water and the sewage can be discharged by a relatively small amount of water.

It is recognized that the flush water should be supplied under a pressure of 0.7 $Kgf/cm^2$ in order to produce a sufficient flush water jet from the jet hole 101. Therefore, the conventional siphon-jet flush water supply system cannot be employed on higher floors of tall buildings because the available flush water supply pressure is too low on those floors.

The external water supply pipe for supplying flush water to the conventional siphon-jet flush water supply system on lower floors of tall buildings should be relatively large in diameter for avoiding a pressure loss, and hence its layout is relatively difficult to design.

Another typical flush toilet design employs a water tank for temporarily storing flush water from an external water supply, which may be of a relatively low water pressure. Flush water is introduced into the flush toilet under the pressure of the flush water stored in the water tank. Once the flush water is fully discharged out of the water tank, the toilet cannot be flushed again until the water tank is filled with flush water. Therefore, the flush toilet cannot be continuously flushed. Because the toilet bowl requires at least 8 liters or more of flush water to flush with, the water tank is of a relatively large size and cannot be incorporated in the toilet stool, The water tank makes the entire toilet assembly poor in appearance, and also presents an obstacle to efforts to clean the toilet stool. As used throughout the remainder of the application, the term "toilet stool" is meant to encompass not only the toilet stool of a flush toilet with a siphon-jet flush water supply system, but also the toilet stool together with the separate large storage water tank.

SUMMARY OF THE INVENTION

It is therefore an object of the present invention to provide a siphon-jet flush water supply system which includes a pressurizing pump for drawing flush water under lower pressure and ejecting flush water under higher pressure into a toilet bowl.

According to the present invention, there is provided a flush toilet comprising a toilet stool including a toilet bowl and a trap drainage passage connected to the toilet bowl, the toilet bowl having a water jet hole defined in a bottom region thereof and opening toward the trap drainage passage, and pressurizing means coupled to the water jet hole for drawing water under lower pressure and expelling the water under higher pressure through the water jet hole toward the trap drainage passage to develop a siphon flow to discharge sewage from the toilet bowl through the trap drainage passage.

According to the present invention, there is also provided a flush toilet comprising a toilet stool including a toilet bowl having a water jet hole defined in a bottom region thereof, and a pump coupled to the water jet hole for drawing water under lower pressure directly from an external water supply and expelling the water under higher pressure as a water jet through the water jet hole into the toilet bowl.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
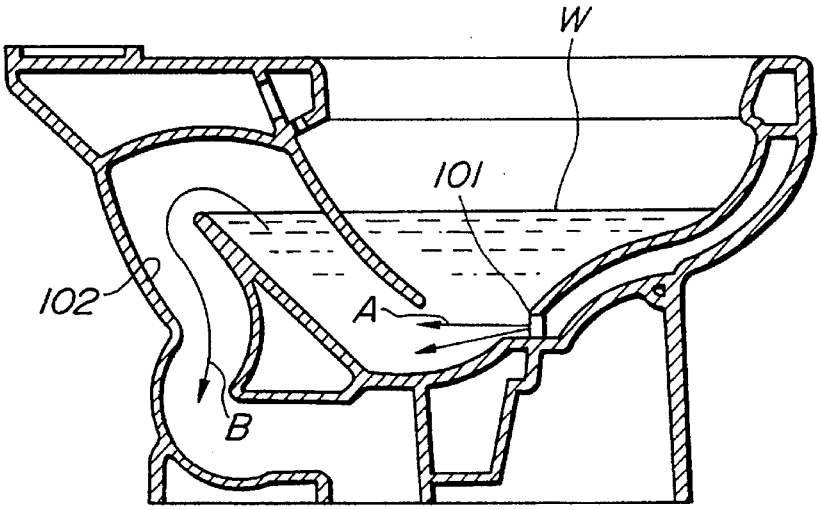
FIG.1 (PRIOR ART)
FIG. 1 is a vertical cross-sectional view of a conventional flush toilet with a siphon-jet flush water supply system.
Figure 2:
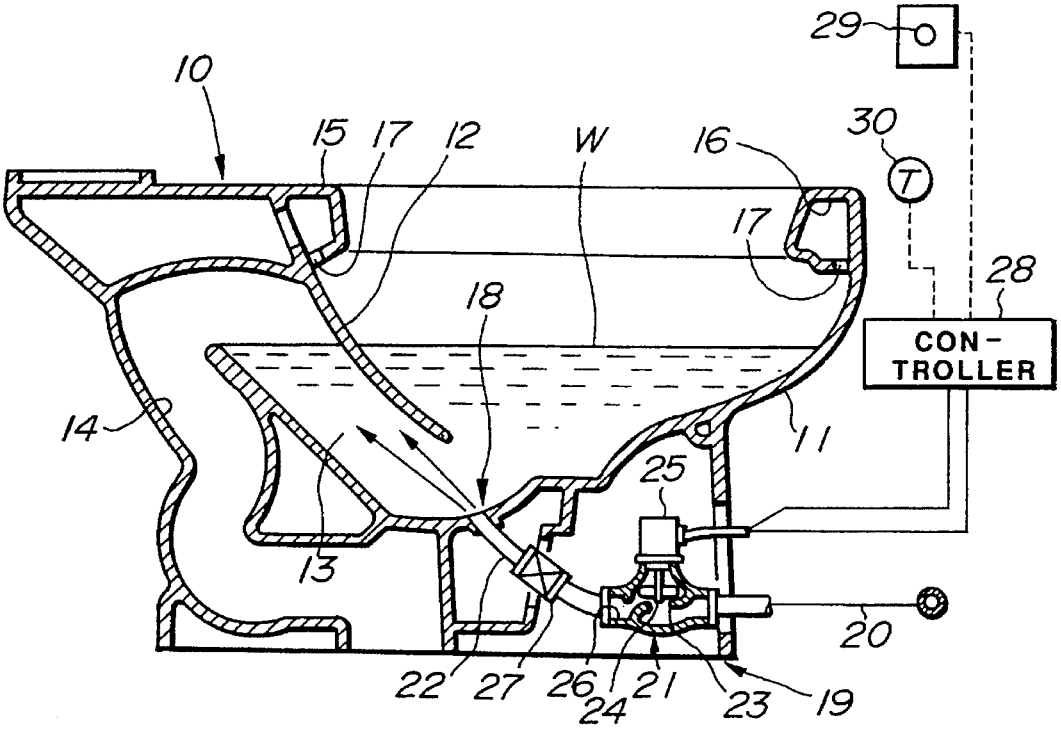
FIG. 2 is a vertical cross-sectional view of a flush toilet with a siphon-jet flush water supply system according to an embodiment of the present invention.

As shown in FIG. 2, a flush toilet with a siphon-jet flush water supply system according to an embodiment of the present invention comprises a toilet stool 10 including a toilet bowl 11 having a rear partition wall 12 which defines an oblique inlet port 13 of a siphon trap drainage passage 14 that extends substantially vertically in a rear portion of the toilet stool 10.

The toilet stool 10 also includes a horizontal rim 15 extending along the upper peripheral edge of the toilet bowl 11. The rim 15 is of a hollow structure having a water passageway 16 defined therein and a plurality of water outlet holes 17 defined in its bottom region at spaced intervals and opening toward the inner circumferential surface of the toilet bowl 11.

The toilet bowl 11 has a water jet hole 18 defined in a bottom wall thereof and opening toward the inlet port 13 of the siphon drain passage 14.

The siphon-jet flush water supply system, generally denoted by 19, is positioned below the toilet bowl 11. The siphon-jet flush water supply system 19 comprises a primary water pipe 20 connected to a low-pressure water supply pipe such as an external water supply pipe, a pressurizing unit 21 positioned below the toilet bowl 11 and connected to the primary water pipe 20, and a secondary water pipe 22 extending from the pressurizing unit 21 to the water jet hole 18.

The pressurizing unit 21, which is in the form of a water pump such as a line pump, a centrifugal pump, a gear pump, a vane pump, or a turbine pump, comprises a suction inlet 23 connected to the primary water pipe 20, an impeller 24 rotatably positioned directly above the suction port 23, a motor 25 for rotating the impeller 24 about its own axis, and a discharge outlet 26 connected to the secondary water pipe 22. The secondary water pipe 22 has a check valve 27 for preventing water from flowing from the toilet bowl 11 back to the pump 21.

The motor 25 is electrically connected to a controller 28 to which there are connected a start switch 29 for applying a start signal to the controller 28 and a timer 30 for measuring a predetermined period of time that elapses after the start signal is applied from the start switch 29 to the controller 28.

when the user of the toilet turns on the start switch 29, the controller 28 starts actuating the pump 21 which draws water under lower pressure from the primary water pipe 20 and propels the water under higher pressure into the secondary water pipe 22, from which the water is ejected out of the water jet hole 18 into the toilet bowl 11.

The ejected water jet from the water jet hole 18 develops a negative pressure in the pool W of water to produce a siphon flow in the inlet port 13 of the siphon drain passage 14, discharging the sewage together with the water W out of the siphon drain passage 14. After elapse of a predetermined period of time measured by the timer 30, the controller 28 inactivates the pump Flush water is also supplied from the water passageway 16 through the water outlet holes 17 into the toilet bowl 11.

Since the siphon-jet flush water supply system 19 has the pump 21 for propelling flush water under higher pressure into the toilet bowl 11, the flush toilet may be installed in a place where flush water is available under relatively low pressure from the external water supply system pipe, and the primary water pipe 20 and the external water supply system pipe connected thereto may be of a relatively small diameter and arranged in a layout that can be designed with ease.

Figure 3:
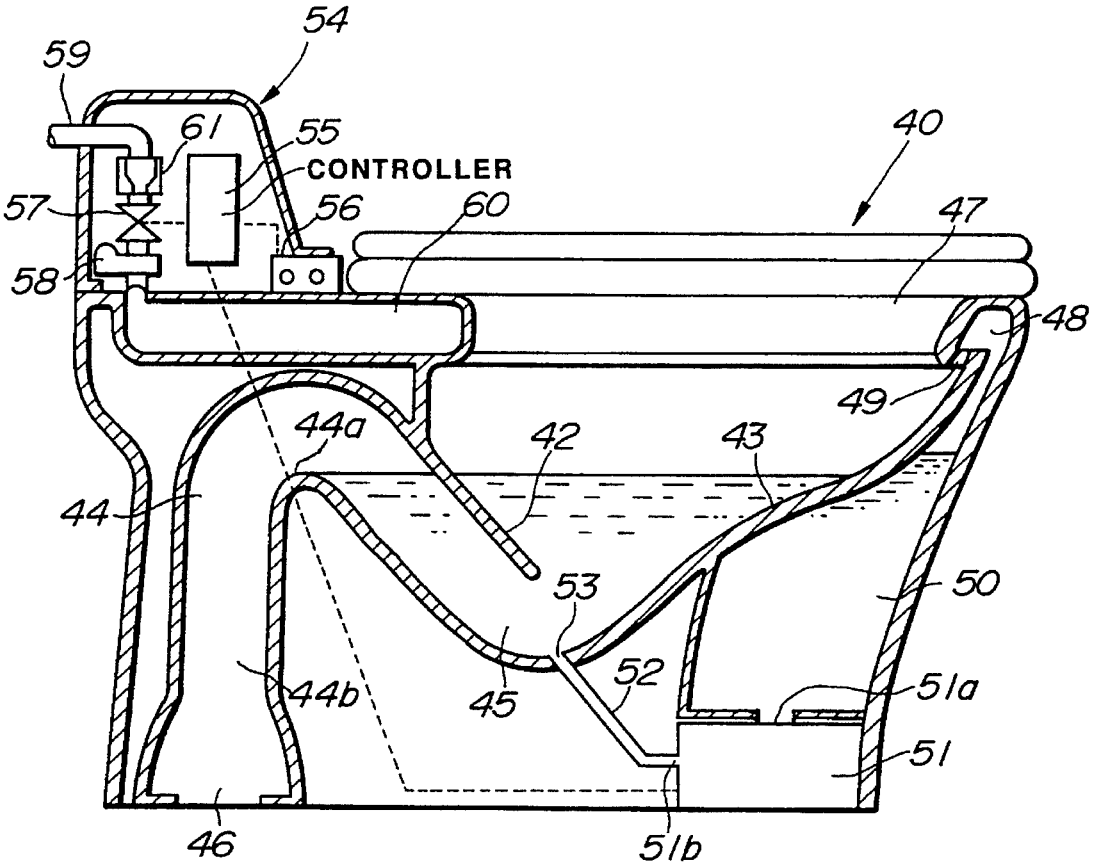
FIG. 3 is a vertical cross-sectional view of a flush toilet with a siphon-jet flush water supply system according to another embodiment of the present invention.

FIG. 3 shows a flush toilet with a siphon-jet flush water supply system according to another embodiment of the present invention.

As shown in FIG. 3, the flush toilet comprises a toilet stool 40 including a toilet bowl 43 having a rear partition wall 42 which defines an oblique inlet port 45 of a substantially inverted V-shaped siphon trap drainage passage 44. The trap drainage passage 44 includes a barrage **44*a* at the upper end of the inlet port 45 and a substantially vertical drain tube 44*b* extending downstream of the barrage 44*a* and having a lower outlet port 46**.

The toilet stool 40 also includes a horizontal rim 47 extending along the upper peripheral edge of the toilet bowl 43. The rim 47 is of a hollow structure having a water passageway 48 defined therein and a plurality of water outlet holes 49 defined in its bottom region at spaced intervals and opening toward the inner circumferential surface of the toilet bowl 43.

The toilet stool 40 also has an integral water tank 50 disposed underneath the toilet bowl 43 In communication with the water passageway 48. A water pump 51, which may be of any of various types described above, is located underneath the water tank 50 and ham a auction inlet **51*a* communicating with the water tank 50. The water pump 51 has a discharge outlet 51*b* that is connected through a water pipe 52 to a water jet hole 53 defined in a bottom wall of the toilet bowl 43 and opening toward the inlet region 45**.

The siphon-jet flush water supply system, generally denoted by 54, is mounted on a rear upper surface of the toilet stool 40. The siphon-jet flush water supply system 54 comprises a controller 55, a start switch 56 for applying a start signal to the controller 55, a valve mechanism 57, and a vent valve 58. A water pipe 59 connected to an external water supply is connected through a constant-flow valve 61, the valve mechanism 57, and the vent valve 58 to a water supply chamber 60 that is defined in the toilet stool 40 beneath the siphon-jet flush water supply system 54 and communicates with the water passageway 48.

Figure 4:
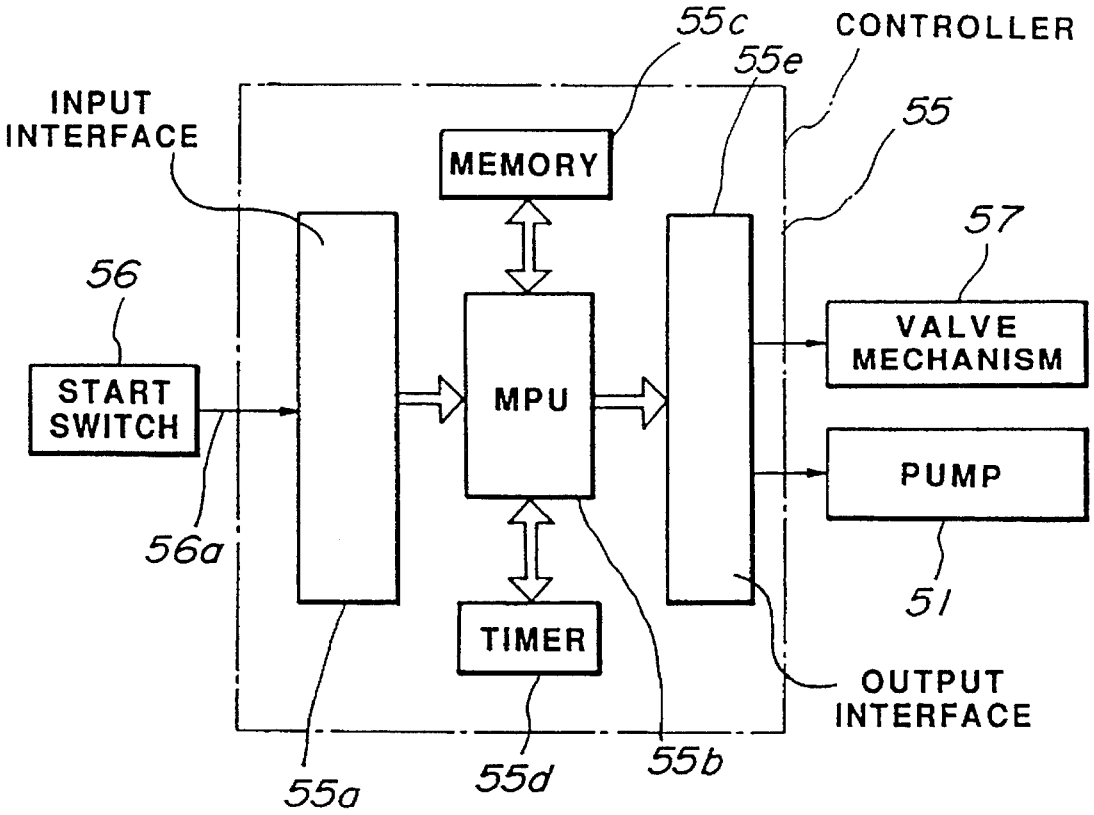
FIG. 4 is a block diagram of a controller of the siphon-jet flush water supply system shown in FIG. 3.

As shown in FIG. 4, the controller 55 comprises an input interface **55*a*, a microprocessor unit (MPU) 55*b*, a memory 55*c*, a timer 55*d*, and an output interface 55*e*. The start switch 56 is connected to the input interface 55*a* through a signal line 56*a*. The output interface 55*e* is connected to the valve mechanism 57 and the pump 51. The valve mechanism 57** comprises a solenoid-operated valve which is opened when a predetermined voltage is applied to the solenoid thereof.

The memory **55*c*** stores various items of data with respect to a flush water supply sequence, an amount of flush water to be supplied, and periods of time in which to supply flush water.

The timer **55*d* starts measuring time in response to a start signal applied from the start switch 56 to the MPU 55*b***.

An operation sequence of the siphon-jet flush water supply system 54 will be described below with reference to FIG. 5.

When a start signal is applied from the start switch 56, the MPU **55*b* turns on the timer 55*d*, which starts measuring time in a step S1. Then, the MPU 55*b* applies a signal through the output interface 55*e* to open the valve mechanism 57 in a step S2. When the valve mechanism 57 is opened, flush water is supplied from the water pipe 59 through the water supply chamber 60 to the water passageway 48, from which the flush water flows through the water outlet holes 49 onto the inner surface of the toilet bowl 43, thereby washing the toilet bowl 43. The flush water also flows from the water passageway 48 into the water tank 50**.

While the flush water is being supplied from the water passageway 48 through the water outlet holes 49 onto the inner surface of the toilet bowl 43, the MPU **55*b* monitors the time as it is measured by the timer 55*d*. Upon elapse of a predetermined period of time, stored in the memory 55*c*, for supplying flush water from the water outlet holes 49 to the toilet bowl 43 in a step S3, the MPU 55*b* closes the valve mechanism 57 in a step S4. The MPU 55*b* also actuates the water pump 51 in a Step S5. The water pump 51 now draws flush water from the water tank 50 and propels it as a water jet out of the water jet hole 53 into the inlet port 45. The water jet forced into the inlet port 45 develops a negative pressure, which draws water from the toilet bowl 43 into the trap drainage passage 44, thus producing a siphon flow therein. The sewage is now discharged together with the water through the trap drainage passage 44 out of the outlet port 46** thereof.

Upon elapse of a predetermined period of time, stored in the memory 55*c*, for supplying a flush water jet through the water jet hole 53 in a step S6, the MPU 55*b* inactivates the pump 51 in a step S7, and opens the valve mechanism 57 in a step S8.

The siphon flow is continuously produced until the level of water in the toilet bowl 43 drops to the lower end of the partition wall 42 and air flows into the trap drainage passage 44. Thereafter, flush water supplied from the water outlet holes 49 builds up in the toilet bowl 43 and seals the toilet bowl 43, and flush water is also supplied to the water tank 50.

When a predetermined period of time, stored in the memory 55*c*, for sealing the toilet bowl 43 has elapsed in a step S9, the MPU 55*b* closes the valve mechanism B7 in a step S10 and turns off the timer 55*d* in a step S11. Now, one cycle of toilet flushing operation is completed.

Figure 5:
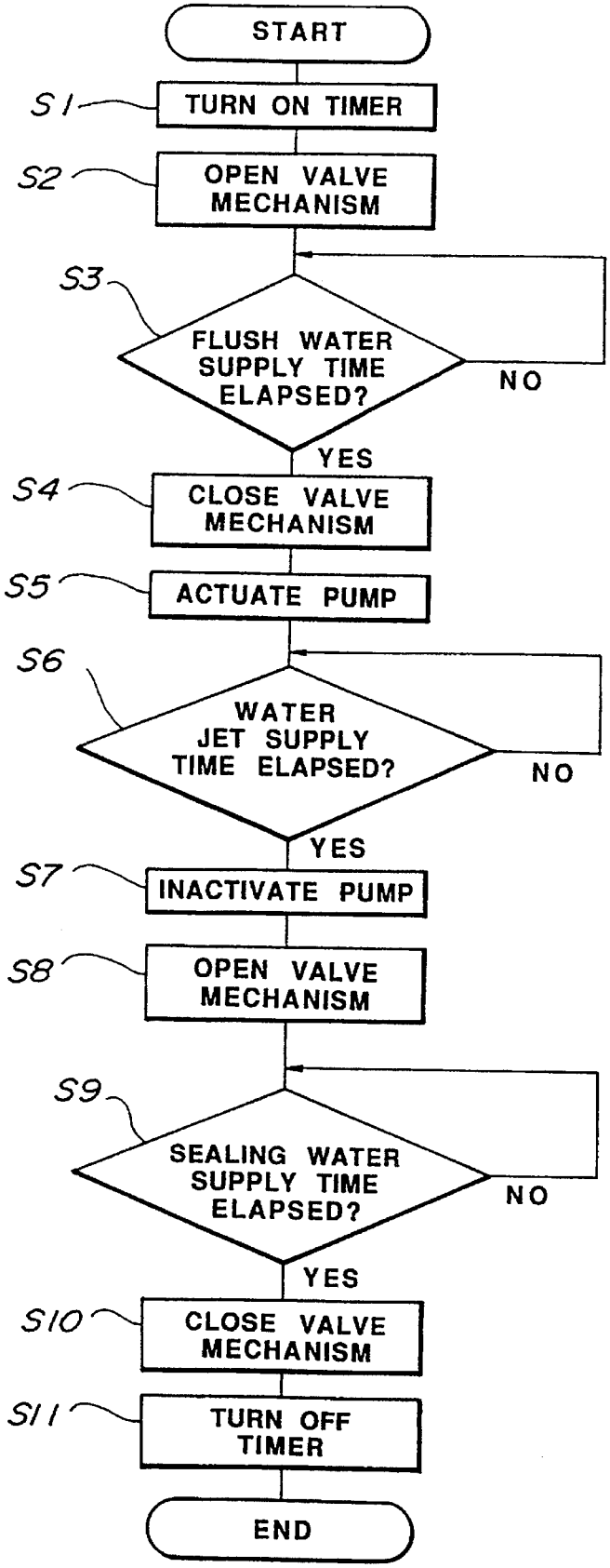
FIG. 5 is a flowchart of an operation sequence of the siphon-jet flush water supply system shown in FIG. 3.

In the operation sequence shown in FIG. 5, the valve mechanism 57 is closed while the water pump 51 is being actuated. However, the valve mechanism 57 may be open while the water pump 51 is being actuated.

Figure 6:
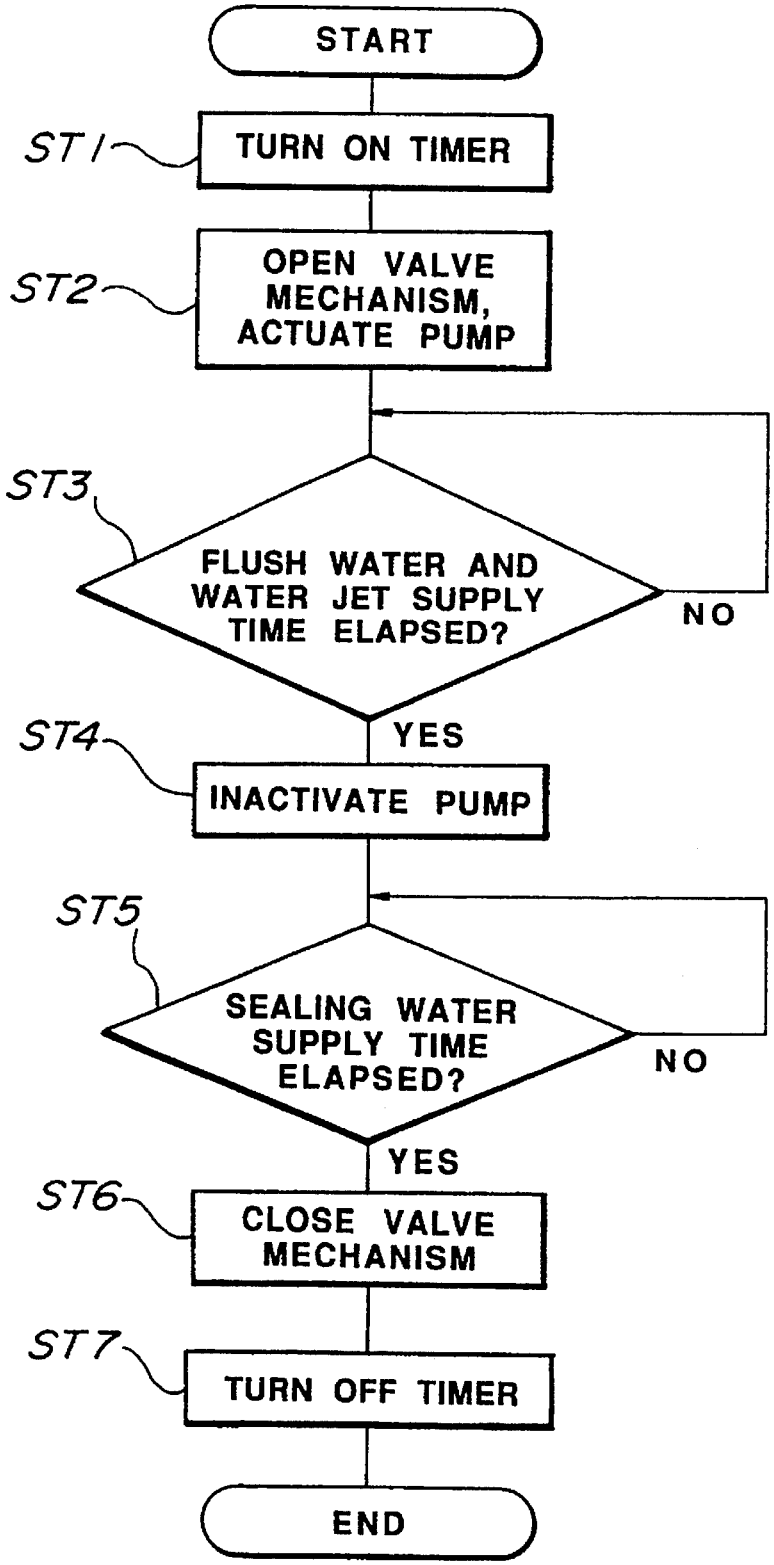
FIG. 6 is a flowchart of another operation sequence of the siphon-jet flush water supply system shown in FIG. 3.

FIG. 6 shows another operation sequence of the siphon-jet flush water supply system shown in FIG. 3.

In FIG. 6, when a start signal is applied from the start switch 56, the MPU 55*b* turns on the timer 55*d*, which starts measuring time in a step ST1. Then, the MPU 55*b* applies a signal through the output interface 55*e* to open the valve mechanism 57 and actuate the water pump 51 in a step ST2. When the valve mechanism 57 is opened, flush water is supplied from the water pipe 59 through the water supply chamber 60 to the water passageway 48, from which the flush water flows through the water outlet holes 49 onto the inner surface of the toilet bowl 43, thereby washing the toilet bowl 43. The flush water also flows from the water passageway 48 into the water tank 50. At the same time, The water pump 51 draws flush water from the water tank 50 and propels it as a water jet out of the water jet hole 53 into the inlet port 45. The water jet forced into the inlet port 45 develops a negative pressure, which draws water from the toilet bowl 43 into the trap drainage passage 44, thus producing a siphon flow therein. The sewage is now discharged together with the water through the trap drainage passage 44 out of the outlet port 46 thereof.

Upon elapse of a predetermined period of time, stored in the memory 55*c*, for supplying flush water to the toilet bowl 43 and a flush water jet through the water jet hole 53 in a step ST3, the MPU 55*b* inactivates the pump 51 in a step ST4.

The siphon flow is continuously produced until the level of water in the toilet bowl 43 drops to the lower end of the partition wall 42 and air flows into the trap drainage passage 44. Thereafter, flush water supplied from the water outlet holes 49 builds up in the toilet bowl 43 and seals the toilet bowl 43, and flush water is also supplied to the water tank 50.

When a predetermined period of time, stored in the memory 55*c*, for sealing the toilet bowl 43 has elapsed in a step ST5, the MPU 55*b* closes the valve mechanism 57 in a step ST6 and turns off the timer 55*d* in a step ST7. Now, one cycle of toilet flushing operation is completed.

The water tank 50 may be supplied with water not through the water passageway 48, but directly from the water supply pipe 59, so that the valve mechanism 57 and the water pump 51 may be inactivated at the same time.

The flush toilet shown in FIG. 3 may be equipped with a selector switch for opening the valve mechanism for different periods of time respectively in excretion and urination modes to supply different amounts of water to the toilet bowl 43. The selector switch is effective to save the total amount of flush water consumed by the flush toilet.

Normally, the amount of flush water discharged from the water jet hole 53 in one cycle of flushing operation is about 2 liters. Therefore, the water tank 50 for storing flush water to be expelled as a water jet may be small enough to be housed in the toilet stool 40 itself underneath the toilet bowl 43. The flush toilet with the water tank 50 incorporated in the toilet stool 40 is of a good appearance and can easily be cleaned.

Figure 7:
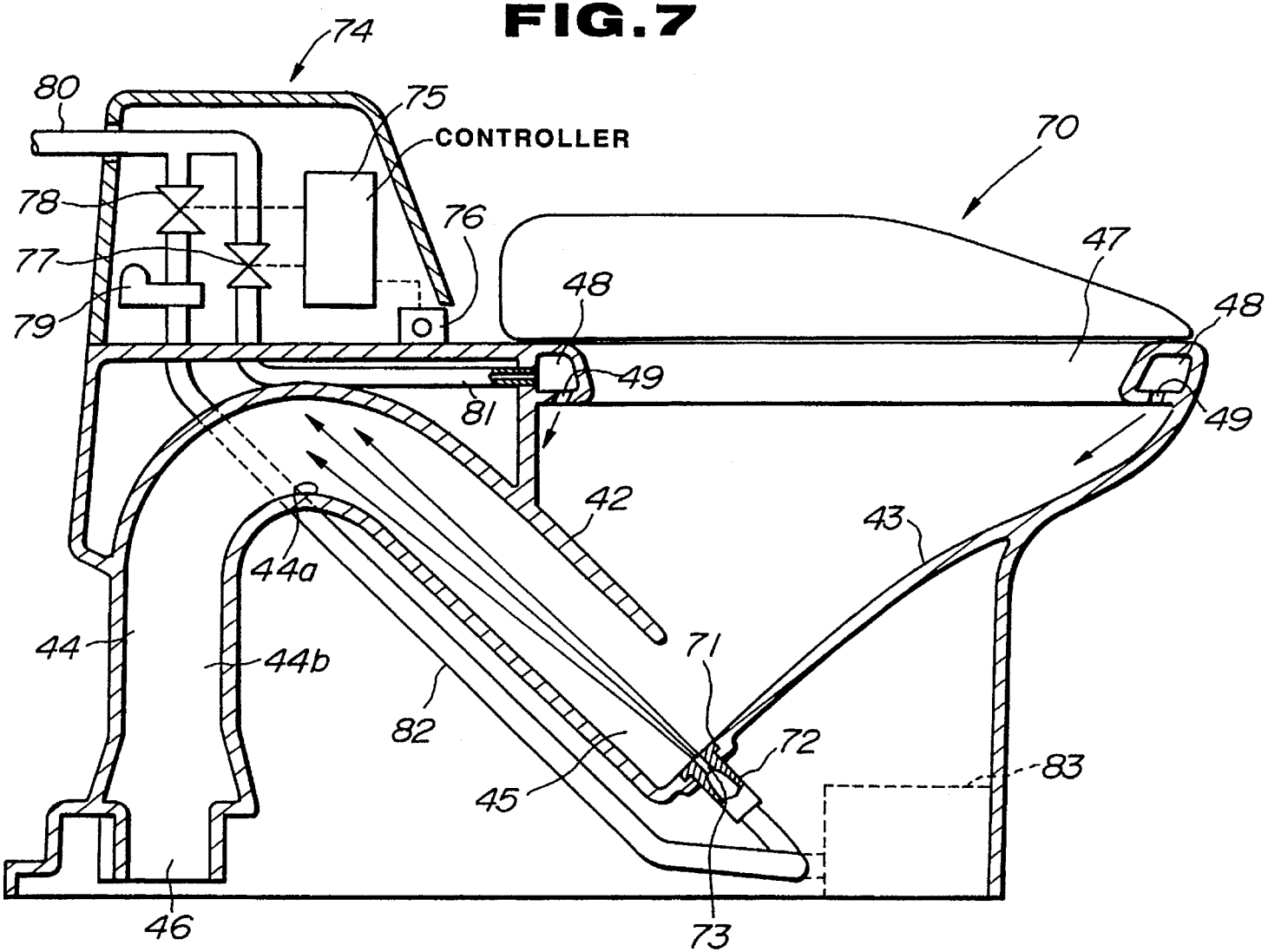
FIG. 7 is a vertical cross-sectional view of a flush toilet with a siphon-jet flush water supply system according to still another embodiment of the present invention.

FIG. 7 shows a flush toilet with a siphon-jet flush water supply system according to still another embodiment of the present invention.

Those parts of the flush toilet shown in FIG. 7 which are identical to those shown in FIG. 3 are denoted by identical reference numerals and will not be described in detail below.

As shown in PEG. 7, the flush toilet has a toilet stool 70 with the toilet bowl 43 having a water jet hole 71 defined in the bottom wall of the toilet bowl 43 and opening toward the inlet port 45 of the trap drainage passage 44. A nozzle 72 which is fitted in the water jet hole 71 in a water-tight manner has an end surface lying flush with the surface of the bottom wall of the toilet bowl 43. The nozzle 72 has an orifice 73 defined coaxially therein and having an open end opening at the end surface of the nozzle 72. Since the end surface of the nozzle 72 which is exposed to flush water in the toilet bowl 43 lies flush with the surface of the toilet bowl 43, the sewage can be washed away with a minimum amount of flush water without being obstructed or trapped by the nozzle 72.

The siphon-jet flush water supply system, generally denoted by 74, is mounted on a rear upper surface of the toilet stool 70. The siphon-jet flush water supply system 74 comprises a controller 75, a start switch 76 for applying a start signal to the controller 75, a rim valve mechanism 77, a jet valve mechanism 78, and a vent valve 79. A water pipe 80 connected to an external water supply is connected through the rim valve mechanism 77 and a water pipe 81 to the water passageway 48 in the rim 47. The water pipe 80 is also coupled through the jet valve mechanism 78, the vent valve 79, and a water pipe 82 to the nozzle 72.

The controller 75 Is essentially identical to the controller 55 shown in FIG. 4 except that the input interface is connected to the start switch 76, the output interface is connected to the rim and jet valve mechanisms 77, 78, and the memory 55*c* stores different items of data.

Figure 8:
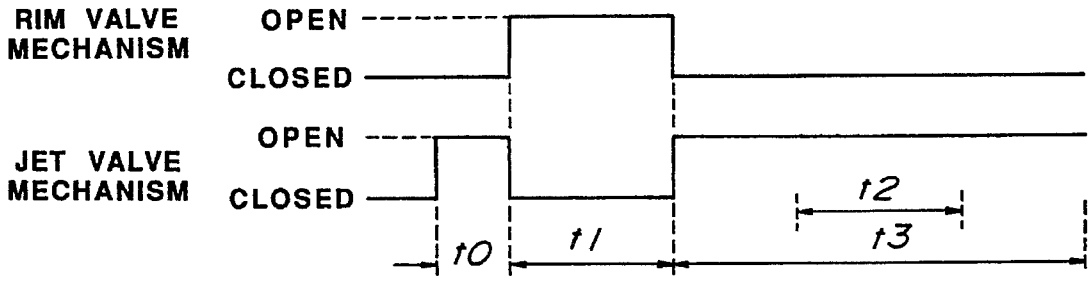
FIG. 8 is a timing chart of a flush water supply sequence of the siphon-jet flush water supply system shown in FIG. 7.

A flush water supply sequence of the siphon-jet flush water supply system shown in PIG. 7 will be described below with reference to FIG. 8.

In response to a start signal from the start switch 76, the controller 75 opens the jet valve mechanism 78. When the jet valve mechanism 78 is opened, water is supplied from the water pipe 80, the jet valve mechanism 78, the vent valve 79, and the water pipe 82 to the nozzle 72, and ejected as a water jet from the orifice 73 toward the inlet port 45 of the trap drainage passage 44. Inasmuch as the nozzle 72 does not project into the toilet bowl 43, the nozzle 72 does not obstruct or trap the sewage moving in the toilet bowl 43.

Upon elapse of a period of time to as measured by the timer, the controller 75 closes the jet valve mechanism 78 and opens the rim valve mechanism 77. The water jet from the nozzle 72 is stopped, and flush water starts to be supplied from the water pipe 80, the rim valve mechanism 77, and the water pipe 81 to the water passageway 48, from which the flush water flows through the water outlet holes 49 into the toilet bowl 43, washing the toilet bowl 43.

Upon elapse of a period of time t1 as measured by the timer, the controller 75 closes the rim valve mechanism 77 and opens the jet valve mechanism 78. The nozzle 72 expels a water jet again into the trap drainage passage 44. The expelled water jet develops a siphon flow in trap drainage passage 44 during a period of time t2 for thereby carrying the sewage together with flush water down the trap drainage passage 44 out of outlet port 46. The water jet is continuously ejected to remove the sewage completely from the toilet bowl 43 and the trap drainage passage 44.

The siphon flow is eliminated when the level of water in the toilet bowl 43 drops to the lower end of the partition wall 42 and air flows into the trap drainage passage 44.

Upon elapse of a period of time t3 from the time when the jet valve mechanism 78 is opened, the controller 55 closes the jet valve mechanism 78. Now, one cycle of toilet flushing operation is finished.

The jet valve mechanism 78 may be controlled to supply water intermittently to the nozzle 72, so that the nozzle 72 may eject intermittent water jets. The jet valve mechanism 78 may comprise a flow rate regulating valve for supplying a water jet at a varying rate.

The water pipe 82 may be connected to the nozzle 72 through a water pump 83 (see FIG. 7) similar to the water pump 21 (FIG. 2) or the water pump 51 (FIG. 3) so that a water jet can be expelled under higher pressure from the nozzle 72 into the inlet port 45 of the trap drainage passage 44.

As will be understood from the foregoing discussion, the pumps 21, 51 according to the embodiments of FIGS. 2 and 3, as well as the nozzle 72 (with or without pump 83) according to the embodiment of FIG. 7, all function to increase the velocity of water supplied through a water jet hole into the toilet bowl relative to the velocity of water which is received by the toilet from an external water supply. The water jet with increased velocity functions, in turn, to efficiently drain water and excrement from the toilet bowl through the toilet's siphon trap drainage passage.

Although there have been described what are at present considered to be the preferred embodiments of the invention, it will be understood that the invention may be embodied in other specific forms without departing from the essential characteristics thereof. The present embodiments are therefore to be considered in all respects are illustrative, and not restrictive. The scope of the invention is indicated by the appended claims rather than by the foregoing description.

What is claimed is:

1. A flush toilet comprising:

a toilet stool including a toilet bowl and a trap drainage passage connected to said toilet bowl, said toilet bowl having a water jet hole defined in a bottom region thereof and opening toward said trap drainage passage;

pressurizing means adjacent said toilet stool and coupled to said water jet hole for drawing water under a first pressure and expelling the water under a second pressure higher than said first pressure through said water jet hole toward said trap drainage passage to develop a siphon flow in said trap drainage passage to discharge sewage from said toilet bowl through said trap drainage passage; and said pressurizing means expels the water under said second, higher pressure upwardly through said water jet hole.

2. A flush toilet according to claim 1, wherein said pressurizing means comprises a water pump having an outlet port and an inlet port which is adapted to be connected to an external water supply further comprising a water pipe interconnecting said water jet hole and said outlet port of the water pump.

3. A flush toilet according to claim 1, further comprising a controller for actuating said pressurizing means in response to a start signal.

4. A flush toilet according to claim 1, wherein said toilet stool includes a water tank disposed within a lower portion thereof and connected to said pressurizing means, a rim extending around an upper circumferential edge of said toilet bowl and having a water passageway communicating with said water tank for supplying water to the tank, and valve means communicating with said water passageway for controlling the supply of water to said passageway.

5. A flush toilet according to claim 4, further comprising a controller for controlling said pressurizing means and said valve means according to a predetermined sequence stored in a memory of said controller.

6. A flush toilet according to claim 1, further comprising a nozzle fitted in said water jet hole and having an end surface lying flush with a Buff ace of the bottom region of said toilet bowl.

7. A flush toilet comprising:

a toilet stool including a toilet bowl having a water jet hole defined in a bottom region thereof; and a pump adjacent said toilet stool and coupled to said water jet hole for drawing water under a first pressure from an external water supply and expelling the water under a second pressure higher than said first pressure as a water jet upwardly through said water jet hole into said toilet bowl.

8. A flush toilet according to claim 7, wherein said toilet further includes a trap drainage passage extending upwardly from said lower region of said toilet bowl, and said pump is adapted to draw the water under said first pressure directly from the external water supply and discharge the water toward said trap drainage passage.

9. A flush toilet according to claim 7, wherein said toilet stool includes a water tank disposed in a lower portion thereof and operatively connected between said pump and the external water supply.

10. A flush toilet according to claim 9, wherein said water tank is disposed beneath said toilet bowl and formed integrally with said toilet stool.

11. A flush toilet according to claim 9, wherein said toilet stool further includes a rim extending around an upper circumferential edge of said toilet bowl and having a water passageway communicating with said water tank for supplying water thereto, and vane means communicating with said water passageway for controlling the supply of water to said water passageway.

12. A flush toilet according to claim 11, further comprising means for controlling said pump and said valve means according to a predetermined sequence stored in the memory of said controlling means.

13. A flush toilet comprising:

a toilet stool including a toilet bowl having a water jet hole defined in a bottom region thereof and a trap drainage passage extending from said toilet bowl;

means adjacent said toilet stool for receiving water from an external water supply at a first velocity;

means adjacent said toilet stool for expelling the water as a water jet at a second velocity greater than said first velocity, upwardly through said water jet hole into said toilet bowl for creating a siphon in said trap drainage passage to discharge water from said toilet bowl; and means for controlling said expelling means in response to a start signal and according to a predetermined sequence stored in a memory of said controlling means.

14. A flush toilet according to claim 13, wherein said expelling means comprises a nozzle fitted in said water jet hole and having an end surface lying flush with a surface of the bottom region of said toilet bowl.

15. A flush toilet according to claim 14, wherein said expelling means further comprises a water pump and a water pipe interconnecting said nozzle and an outlet port of said water pump.

16. A flush toilet according to claim 13, wherein said expelling means comprises a water pump and a water pipe interconnecting said water jet hole and an outlet port of said water pump.

17. A flush toilet according to claim 16, wherein said toilet stool includes a water tank disposed in a lower portion thereof and operatively connected between said receiving means and said expelling means, a rim extending around an upper circumferential edge of said toilet bowl and having a water passageway communicating with said water tank for supplying water thereto, and valve means communicating with said water passageway for controlling a supply of water to said water passageway from said receiving means.

18. A flush toilet according to claim 17, further comprising control means for controlling said expelling means and said valve means according to a predetermined sequence stored in a memory of said control means.

19. A flush toilet according to claim 1, wherein said toilet bowl and said trap drainage passage are formed as an integral unitary member, and said trap drainage passage extends substantially vertically upwardly from a lower portion of said toilet bowl.

* * * * *

UNITED STATES PATENT AND TRADEMARK OFFICE

CERTIFICATE OF CORRECTION

PATENT NO. : 5,502,845

DATED : April 2, 1996

INVENTOR(S) : Hayashi et al.

It is certified that error appears in the above-indentified patent and that said Letters Patent is hereby corrected as shown below:

Column 4, line 5, change "ham" to --has--; change "auction" to --suction--

Column 5, line 15, change "B7" to --57--;

Column 6, line 19, change "PEG" to --FIG--;

Column 8, line 52, change "vane" to --valve--.

Signed and Sealed this

Second Day of July, 1996

Bruce Lehman

*Attest:*

BRUCE LEHMAN

*Attesting Officer*

*Commissioner of Patents and Trademarks*